United States Patent [19]

Krulewich

[11] 4,074,987

[45] Feb. 21, 1978

[54] DEFROST SENSING SYSTEM FOR FREEZER COMPARTMENT

[75] Inventor: Edward B. Krulewich, Louisville, Ky.

[73] Assignee: General Electric Company, Louisville, Ky.

[21] Appl. No.: 756,232

[22] Filed: Jan. 3, 1977

[51] Int. Cl.[2] ..... F25D 21/08

[52] U.S. Cl. ..... 62/128; 62/156; 62/273

[58] Field of Search ..... 62/128, 156, 80, 273, 62/451

[56] References Cited

U.S. PATENT DOCUMENTS

| | | | |
|---|---|---|---|
| 2,479,733 | 8/1949 | Dodson | 62/451 X |
| 2,644,422 | 7/1953 | Carbary | 62/128 X |

*Primary Examiner*—William E. Wayner

*Attorney, Agent, or Firm*—Francis H. Boos

[57] ABSTRACT

A two-door household refrigerator with a separate freezer compartment and a manually-initiated freezer defrost cycle. A frost-sensing means is located in the thermal insulation in outer-spaced relation from the combined freezer liner and evaporator. The frost sensing means is thermally sensitive at a preselected high temperature of the insulation at the completion of the defrost cycle.

10 Claims, 4 Drawing Figures

DEFROST SENSING SYSTEM FOR FREEZER COMPARTMENT

BACKGROUND OF THE INVENTION (1) Field of the Invention

This invention relates to a refrigerator with a manually-initiated defrost system for a separate freezer compartment, and particularly to a freezer defrost sensing system to assist the user in determining when the frost has melted sufficiently on the exterior of the freezer liner to warrant ending the defrost cycle.

(2) Description of the Prior Art

In a two-door refrigerator, there is a fresh food compartment and a separate freezer compartment. The fresh food compartment is cooled by evaporator coils located within the top portion of that compartment, while the freezer compartment is cooled by evaporator coils around the outside thereof. There are models of refrigerators where the fresh food compartment is self-defrosting, while the freezer compartment must be manually defrosted. Defrosting of the fresh food compartment takes place automatically every time the compressor turns off. A manually settable temperature control is located within the fresh food compartment and it causes the compressor to turn ON and OFF in order to maintain a preselected temperature. Frost collects on both the refrigerator coils and on the freezer compartment surfaces while the compressor is operating. When the compressor is OFF, the coils in the fresh food compartment are warm enough to defrost; however, the freezer compartment coils remain below freezing temperature and they do not defrost. Therefore, frost builds up on both the interior and exterior surfaces of the freezer compartment liner and it is necessary for the user to periodically turn the compressor off for a long period of time, for example a minimum of two hours, to insure complete defrosting of the freezer compartment. This should be done whenever frost becomes of a thickness between ¼ to ½ inch thick in any area on the interior surfaces of the compartment. It is not wise to operate the refrigerator longer than six months without completely defrosting the freezer compartment.

There is a natural tendency for users to terminate a defrost cycle when all visible ice on the inner surfaces of the freezer compartment has melted. This would be contrary to the instructions of the appliance manufacturer for the proper length of the defrost cycle prescribed in the User's instruction manual, because the exterior surfaces of the freezer defrost last.

If the defrost cycle is terminated prematurely, frost would remain on the evaporator coils and the exterior surface of the freezer compartment that are hidden from sight, since a thick blanket of thermal insulation surrounds the freezer compartment and the insulation is located within the outer case of the refrigerator. During a freezer defrost cycle, the frost on the exterior surfaces will melt and water will run down through the low density fiber glass insulation. The lower portion of the insulation may be wet throughout. If the compressor is restarted prematurely, then this water in the insulation may freeze and cause a heavy ice buildup in the vicinity of the lower portion of the freezer compartment.

Attempts have been made in the past for assisting the user in knowing when a defrost cycle should be initiated to eliminate the frost buildup. U.S. Pat. No. 2,071,148 of Weisberg et al discloses a small freezer compartment or evaporator located within the fresh food compartment of a refrigerator. An indicator light is provided to be operated by a switch positioned on the exterior of the evaporator, that is in series with a refrigerator door switch. This first switch will close when a predetermined heavy layer of ice forms on the exterior of the evaporator. Actually, the layer of ice closes the circuit of the switch, thereby energizing the light when the refrigerator door is opened. In this Weisberg et al patent, the evaporator is visible to the user when the refrigerator door is open because the evaporator is located within the fresh food compartment, as in standard refrigerators that have been made for decades.

Later, single-door refrigerators with full width freezer evaporators were made available, and they had a separate evaporator door within the fresh food compartment. It then became difficult for the user to determine the amount of frost collected on the evaporator and especially at the back of the evaporator which is hidden from the view of the user. U.S. Pat. No. 2,644,422 of Carbary, which is assigned to the present assignee, discloses a mechanical indicating means which measures the thickness of the frost on the exterior rear surface of the evaporator whenever the evaporator door is opened, which would indicate to the user the thickness of the frost and the time when the freezer evaporator should be defrosted.

U.S. Pat. No. 3,065,608 of Arzberger discloses an automatically operable defrosting control system for controlling the refrigerator evaporator, and a separate automatically operable defrosting control system for the freezer evaporator. In the latter system, a temperature sensing bulb is fixedly mounted to the freezer evaporator coils, and it is connected by means of a capillary to a bellows that controls the movable contact of a switch in the compressor circuit. When the temperature of the freezer evaporator coils drops to a predetermined low level, indicating the existence of a coating of frost on the freezer evaporator coils, a bellows contracts to open the switch and interrupt the circuit through the compressor motor.

U.S. Pat. No. 3,839,878 of Tilmanis discloses a two-door combination refrigerator-freezer that has temperature sensing devices to monitor the temperature of the freezer evporator coils and the freezer compartment interior. The temperature sensing devices are thermistors mounted to the evaporator coil and one mounted within the freezer compartment. When the difference in these temperatures at those locations exceeds a predetermined value and one of the monitored temperatures is less than a predetermined value, the defrost operation will be initiated.

The principle object of the present invention is to provide a frost sensing means within the insulation surrounding a freezer compartment so as to be thermally sensitive to the temperature of the insulation so that when a preselected high temperature is reached it will be known that the defrost cycle may be terminated.

A further object of the present invention is to provide a frost sensing means of the class described to be located remote from the freezer evaporator so as to be able to determine when the frost on the exterior surface of this evaporator has melted.

A further object of the present invention is to provide a frost sensing means of the class described in combination with an indicating means, which indicating means when energized signifies that the frost level has become excessive and that a defrost cycle should be initiated, and when the indicating means is de-energized to signify that the defrost cycle may be terminated.

A further object of the present invention is to provide a modification with a frost sensing means of the class described with a manual means for initiating the defrost cycle and with thermally sensitive means for terminating the defrost cycle.

SUMMARY OF THE INVENTION

The present invention, in accordance with one form thereof, relates to a combined freezer compartment and evaporator upon which frost collects during its operation. Thermal insulating material surrounds the compartment and a frost sensing means is interposed within the insulation in outer-space relation from the side of the freezer compartment. This frost sensing means is thermally sensitive at a preselected high temperature of the insulation at the completion of a defrost cycle.

BRIEF DESCRIPTION OF THE DRAWINGS

This invention will be better understood from the following description taken in conjunction with the accompanying drawings and its scope will be pointed out in the appended claims.

DESCRIPTION OF THE PREFERRED EMBODIMENTS

Figure 1:
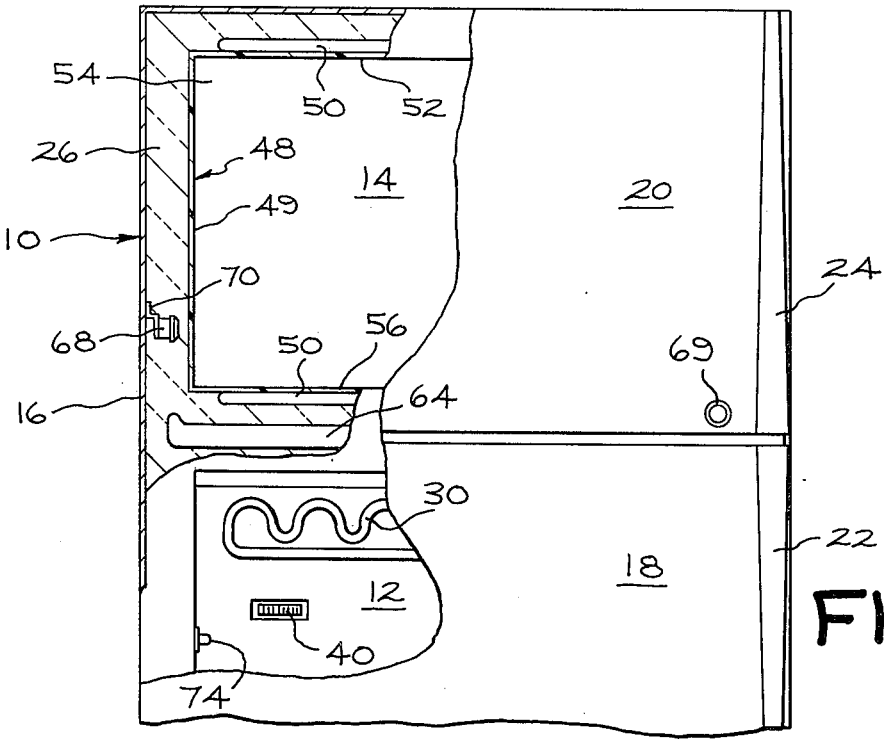
FIG. 1 is a fragmentary front elevational view of the upper portion of a two-door combination refrigerator-freezer with parts broken away and others partly in cross-section to show the interior of the fresh food compartment and the nature of the freezer compartment relative to a frost sensing means positioned within the thermal insulation that surrounds the freezer compartment.

Turning now to a consideration of the drawings, and in particular to FIG. 1, there is shown in front view the top portion of a two-door combination refrigerator-freezer 10 having a lower fresh food compartment 12 and an upper freezer compartment 14 supported within an outer refrigerator case 16. A side-swinging door 18 is mounted on the front of the outer case and it is adapted to close the fresh food compartment 12. Another sideswinging door 20 is mounted to the outer case 16 and is adapted to close the freezer compartment 14. The first door 18 has a door handle 22, while the second door 20 has a door handle 24. A blanket of low density thermal insulation 26 of fiber glass or the like surrounds both the fresh food compartment 12 and the freezer compartment 14 and generally fills the space between those compartments and the outer case 16.

Figure 2:
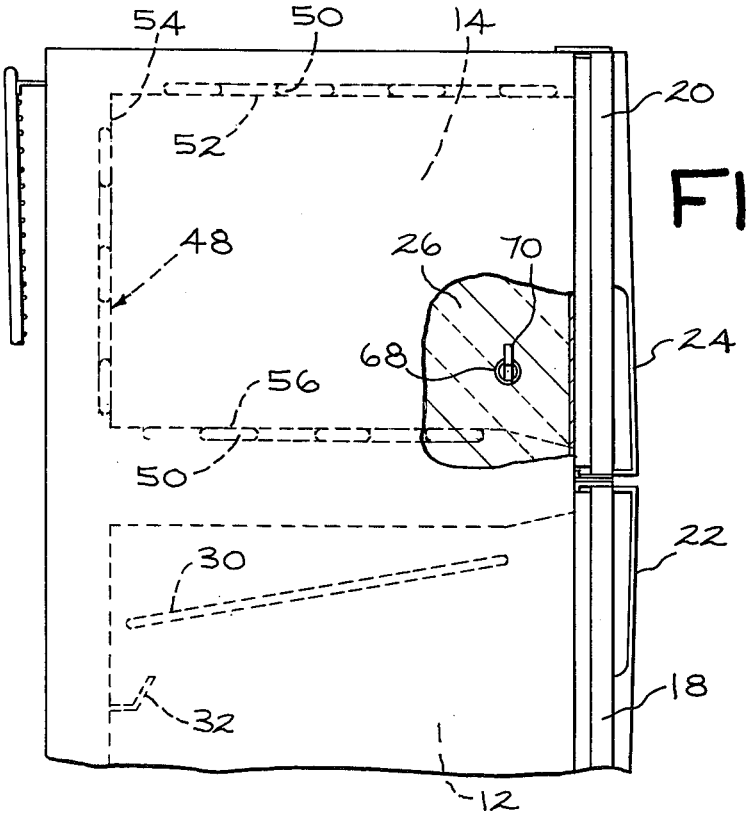
FIG. 2 is a fragmentary side elevational view of the refrigerator-freezer of FIG. 1 with a part of the outer case broken away to show the location of the frost sensing means relative to the freezer compartment and in dotted lines the nature of the freezer evaporator that surrounds the freezer liner, as well as the refrigerator evaporator positioned in the top of the fresh food compartment.

The evaporator coil 30 for the fresh food compartment 12 is positioned within that compartment near the top portion thereof, as is seen in both FIGS. 1 and 2. This refrigerator evaporator 30 will receive a coating of frost when moisture within the compartment 12 is deposited thereon and frozen. This frost occurs as moisture is precipitated from the air circulating within the fresh food compartment as the evaporator cools the air to a temperature below its dew-point temperature. The temperature of this evaporator is below the freezing point of water, and the moisture deposited on the evaporator surface freezes to form a frost formation, which frost is objectionable in this location because it acts as an insulator between the refrigerator evaporator and the air inside the cabinet. This evaporator 30 is defrosted automatically every time the refrigerator compressor turns off. Melted frost water or condensate drains from the evaporator coil 30 into a trough 32 that is fastened on the rear wall of the compartment 12. This water drains out the end of the trough to a drain tube (not shown) in the bottom of the compartment, from which it flows into a pan (not shown) located near the floor.

Figure 3:
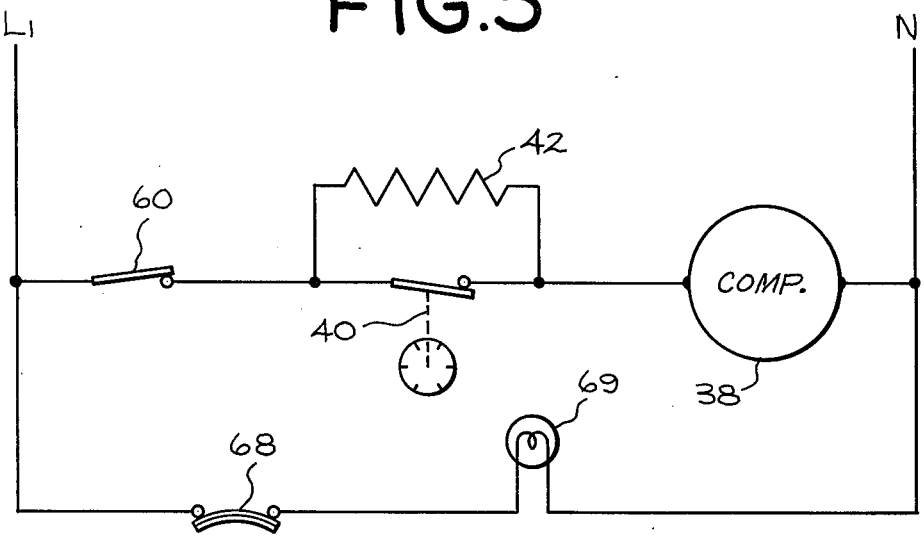
FIG. 3 is a schematic wiring diagram of the thermostatic temperature control for the refrigerator compressor, and the circuit for the frost sensing means in series with the indicator light to warn the user when the freezer compartment should be defrosted.

Looking at the wiring diagram of FIG. 3, the refrigerator 10 is supplied with a grounded power cord that is adapted to be connected to a 120 volt AC source between line $L_1$ and neutral conductor N. A refrigerator compressor 38 is connected across line $L_1$ and neutral and is controlled by a manually settable temperature control thermostat 40 in series therewith. The thermostat is positioned in the fresh food compartment 12 in the back wall thereof, as is seen in FIG. 1. Connected in parallel with the thermostat 40 is a cycle defrost heater 42 that is energized whenever the thermostat 40 cycles open to turn off the compressor 38. The heater 42 defrosts the fresh food evaporator 30.

Turning back to a consideration of FIG. 1, the freezer compartment 14 is formed by a box-like liner 48 which is furnished with an evaporator coil 50 of serpentine shape that is fixed to the exterior surfaces of the liner such as the top wall 52, the rear wall 54 and the bottom wall 56 as is shown in the side view of FIG. 2. The liner 48 of the freezer compartment 14 is sometimes referred to in the refrigerator art as the freezer evaporator, although it may or may not be separate from the evaporator coils 50. However, this term "evaporator" has been so used to include the liner by refrigerator engineers for a long period of time, and it may be so used to include the liner by refrigerator engineers for a long period of time, and it may be so used in this application. Frost builds up on both the interior and exterior surfaces of the liner 48 of the freezer compartment 14. This frost is not melted when the compressor 38 cycles OFF under the control of the temperature control thermostat 40, because of the low operating temperature of the freezer evaporator 50. Hence, the freezer compartment has a manual defrost cycle which must be initiated by the user. The user is instructed to defrost the freezer whenever frost becomes ¼ inch to ½ inch thick in any area within the liner 48. A manual defrost switch 60 is connected in series with the temperature control thermostat 40 and compressor 38. This defrost switch 60 is a normally closed switch that is opened manually to initiate the defrost cycle for the freezer compartment 14. Such a cycle should continue for a minimum of two hours to insure complete defrosting. The freezer door should be left in an open position during this period. All frozen food should be removed from the freezer compartment and wrapped in newspapers in order to prevent thawing while the freezer is being defrosted. A collector pan 64 underlies the entire liner 48 and collects the defrost water as it flows down off the exterior surfaces of the liner. This collector pan 64 also has a drain (not shown) which empties into the fresh food compartment 12. A large bowl would be placed on the top shelf in the fresh food compartment 12 directly under the freezer drain opening to catch the freezer defrost water.

If frost is permitted to form for a long period of time in the freezer such that the frost thickness exceeds ½ inch, it may be necessary to defrost the freezer for as long as 24 hours. This is not desirable because of the possibility that the frozen food might become defrosted and would have to be consumed within a short time rather than being refrozen for future use.

There is a natural tendency for users to interrupt the defrost cycle after all visible frost is removed from the interior surfaces thereof rather than waiting for the time periods recommended in the instruction manual. When this is done prematurely, the frost on the exterior surfaces of the liner 48 and on the freezer evaporator coils 50 will not be completely melted. These surfaces are hidden from view. If these short-term defrost cycles are repeated over long periods of time, there will be a tendency for the frost on the exterior surfaces of the liner to become excessive, especially in the area adjacent the bottom of the freezer liner 48 near the side wall 49 thereof. The thermal insulation 26 is a low density fiber glass material which becomes wet when the frost is melted. If the freezer defrost cycle is terminated prematurely, this wetness may turn into ice and the ice will reduce the effectiveness of the insulation, thereby causing the refrigerator compressor 38 to run excessively and for the side walls of the outer case to sweat, which can be very objectionable to the user.

The present invention comprises a frost sensing means 68 positioned in the insualtion 26 near the bottom portion of the freezer liner in the area between the side wall 49 and the outer case 16, as is seen in both FIGS. 1 and 2.

This frost sensing means 68 may be a bimetal that is supported from a bracket 70 that is attached to the inner surface of the outer case 16, so that the bimetal is remote from the side wall 48 of the freezer liner. It is best to locate this bimetal 68 in a position where the frost or ice buildup in the insulation is the last to melt during a freezer defrost cycle so that the user will be assured that the freezer is completely defrosted. This bimetal switch 68 is a normally open, dual point thermostat which closes at a low temperature of about 20° F. and opens at a high temperature of about 60° F. It will be understood that other critical temperatures could be established without departing from the present invention. Connected in series with the bimetal switch 68 is an indicator light 69 which is energized whenever this switch is closed. The light 69 is shown in FIG. 1 mounted in the front face of the freezer door 20.

Figure 4:
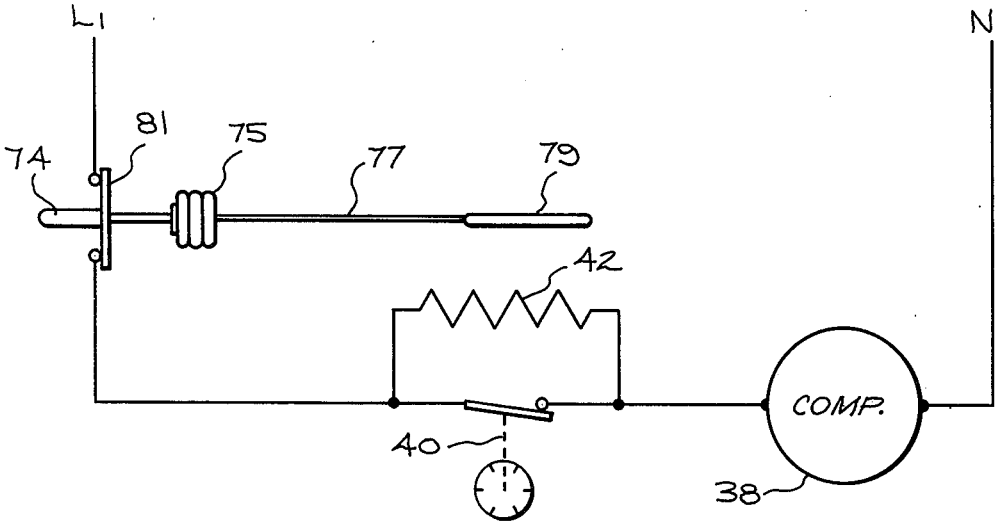
FIG. 4 is a schematic wiring diagram of a modified circuit for controlling the refrigerator compressor showing the frost sensing means in series with the compressor so as to prevent the compressor from being restarted, once the defrost cycle has been manually initiated, until the frost surrounding the freezer compartment has melted.

A second modification of the present invention is shown in FIG. 4 where the same elements of FIG. 3 are shown with the same reference numerals. A frost sensing means 74 is connected in series with the temperature control thermostat 40 and the refrigerator compressor 38 across $L_1$ and neutral conductor N. This frost sensing means 74 is different from the bimetal switch 68 because it is a manually operable pushbutton switch having a hydraulic thermostat with a bellows or diaphragm 75, a capillary tube 77 and a temperature sensing bulb 79. This frost sensing thermostat 74 has a normally closed pushbutton switch 81 that is manually operable when the user wishes to defrost the freezer compartment. Once it is initiated, the switch remains in the open position until the temperature of the insulation 26 rises to a preselected temperature of about 60° F, at which time the bellows 75 will close the switch 81, thereby restarting the compressor 38. Because this frost sensing thermostat 74 must be manually operated, it has to be accessible. It cannot be located within the freezer compartment 14 because the button may become frozen and inoperable. One recommended position for the frost sensing thermostat 74 is within the fresh food compartment 12, as is best seen in FIG. 1. The temperature sensing bulb 79 would be mounted from the bracket 70 of the outer case 16 in place of the frost sensing bimetal switch 68 of FIG. 1.

Modifications of this invention will occur to those skilled in this art. Therefore, it is to be understood that this invention is not limited to the particular embodiments disclosed but that it is intended to cover all modifications which are within the true spirit and scope of this invention as claimed.

What is claimed is:

1. A refrigerator comprising a box-like liner defining both a freezer compartment and evaporator upon which frost collects, thermal insulating material surrounding the liner, and an outer refrigerator case, a frost sensing means interposed within the insulation in outer-spaced relation from the side of the liner and arranged adjacent the bottom, said frost sensing means being thermally sensitive at a preselected high temperature of the insulation at the completion of a defrost cycle.

2. The invention of claim 1 wherein the frost sensing means is a bimetallic member mounted from the refrigerator outer case in an area where the external frost buildup in the insulation is the last to melt during a defrosting cycle of the evaporator.

3. The invention of claim 2 wherein the frost sensing bimetal is a normally open, dual point switch in series with an indicator light whereby the bimetal will energize the light at a preselected low temperature of the insulation and will automatically de-energize the light at a preselected high temperature when the frost buildup in the insulation has melted.

4. The invention of claim 1 with an operating circuit for energizing a refrigerating compressor that serves the said evaporator, the frost sensing means being a normally closed switch in series with the compressor, manual means for opening the frost sensing switch to deenergize the refrigerating compressor when the frost buildup in the insulation becomes excessive, said frost sensing switch being thermally sensitive at a preselected high temperature of the insulation for closing the frost sensing switch and thereby energizing the refrigerating compressor, whereby the frost sensing switch insures that the compressor will remain de-energized until the defrost buildup in the insulation has melted.

5. The invention of claim 1 wherein the thermal insulating material is a low density fiber glass material that becomes wet when the frost melts off of the evaporator.

6. The invention of claim 1 wherein the frost sensing means is a manually activated, single point thermostat located remotely from the thermal insulation surrounding the liner but having a temperature sensing bulb interposed in the insulation spaced outwardly from the side of the liner.

7. A two-door refrigerator comprising an outer case having a fresh food compartment and a separate freezer compartment, the freezer compartment including a box-like liner with external evaporator coils, which liner develops both internal and external frost, thermal insulating material surrounding the freezer liner, and a frost sensing means interposed within the insulation in outer-spaced relation from the side of the freezer liner adjacent an area where the external frost buildup in the insulation is the last to melt during a defrosting cycle of the evaporator, said frost sensing means being thermally actuated at a preselected high temperature of the insulation above 32° F at the completion of a defrost cycle.

8. The invention of claim 7 wherein the frost sensing means is a thermally responsive member mounted from the refrigerator outer case, and the thermal insulating material is a low density fiber glass material that becomes wet when the frost melts off of the evaporator.

9. The invention of claim 8 wherein the frost sensing means is a normally open, dual point thermostat connected in an electrical circuit with an indicator light whereby the thermostat will energize the light at a preselected low temperature of the insulation of about 20° F, and will automatically de-energize the light at a preselected high temperature of about 60° F when the frost buildup has melted 10. The invention of claim 8 wherein the frost sensing means has a manually activated, single point thermostat mounted to the fresh food compartment as well as a temperature sensing bulb joined to the thermostat and interposed in the insulation at the side of the freezer liner.

* * * * *